United States Patent [19]

Leibundgut

[11] 4,118,614

[45] Oct. 3, 1978

[54] MULTIPLE-FUNCTION, HAND-ACTUATED SWITCH UNIT, PARTICULARLY FOR ELECTRICAL HAND TOOLS OR APPLIANCES AND THE LIKE

[75] Inventor: Gottfried Leibundgut, Solothurn, Switzerland

[73] Assignee: Robert Bosch GmbH, Stuttgart, Germany

[21] Appl. No.: 802,712

[22] Filed: Jun. 2, 1977

[30] Foreign Application Priority Data

Jul. 2, 1976 [DE] Fed. Rep. of Germany ..... 2629722

[51] Int. Cl.[2] ..... H01H 13/08

[52] U.S. Cl. ..... 200/157

[58] Field of Search ..... 200/1 V, 153, 157; 310/68 R

[56] References Cited

U.S. PATENT DOCUMENTS

| | | | |
|---|---|---|---|
| Re. 26,781 | 2/1970 | Frenzel | 200/157 |
| 2,487,011 | 11/1949 | Wilhide | 200/157 |
| 2,869,043 | 1/1959 | Locher | 361/353 |
| 2,921,147 | 1/1960 | Hutt | 200/6 BB |
| 2,942,087 | 6/1960 | Meuer | 200/157 |
| 3,260,827 | 7/1966 | Frenzel | 200/157 |
| 3,588,411 | 7/1968 | Milcoy | 200/157 |
| 3,632,936 | 1/1972 | Piber | 200/157 |
| 3,639,822 | 2/1972 | Brown et al. | 200/157 UX |
| 3,703,646 | 11/1972 | Jacyno | 200/157 X |
| 3,755,640 | 8/1973 | Kaman et al. | 200/157 |
| 3,761,663 | 9/1973 | Brown | 200/157 |
| 4,045,637 | 8/1977 | Mongeau | 200/303 |
| 4,057,520 | 11/1977 | Schwartz | 200/16 D |

*Primary Examiner*—Donald Watkins
*Attorney, Agent, or Firm*—Flynn & Frishauf

[57] ABSTRACT

To provide the functions of (a) ON-OFF and, selectively, at least two of the functions of (b) speed control; (c) overload cut-out; (d) forward-reverse rotation; (e) RF interference suppression, in a universally applicable structural unit, a switch housing is provided with an ON-OFF switch and a switch operating handle; and operating control circuits and elements respectively arranged to provide the functions (b) to (e) are attached to the housing to form therewith a unitary assembly and possibly protrude from the housing so that, once space is allocated in the tool or appliance for the housing and the additional units, selective operating or control functions can be associated with the switch as required by the specific tool or appliance.

8 Claims, 3 Drawing Figures

MULTIPLE-FUNCTION, HAND-ACTUATED SWITCH UNIT, PARTICULARLY FOR ELECTRICAL HAND TOOLS OR APPLIANCES AND THE LIKE

CROSS REFERENCE TO RELATED APPLICATION

U.S. Ser. No. 802,651, filed June 2, 1977, Liebundgut assigned to the assignee of the present application.

The present invention relates to a switch unit for use with hand tools, appliances or the like, and more particularly to standardization of such units and associated components to permit mass production of elements and the tools, yet provide flexibility of functional control.

BACKGROUND OF THE INVENTION AND PRIOR ART

Various types of hand tools and appliances require control elements having various types of functions. Basic to the control is an ON-OFF switch. Additionally, some tools or appliances desirably should have overload relays, speed control, RF suppression capacitors, reverse rotation switches and the like. The tools for which the present application is particularly adapted are hand tools such as drills, impact or percussion drills, hand circular saws and the like, as well as other appliances. Customary switch elements or combinations of switches usually were so designed that, at the most, two functions were combined in a single switching unit. A typical combination is an ON-OFF switch and an overload protection switch; or an ON-OFF switch combined with a speed control network for electronic control of the operating speed of the motor of the tool or appliance. Adding additional operating functions beyond the two previously used required assembly of an additional circuit element or network unit to the switch. The location of such additional units has resulted in difficulties, particularly since it is desired to reduce the overall size of the machines and especially the handles therefor. Adding functions to the switch unit therefore required differences in the construction of the handle to accomodate the further elements or components. Although the basic tool may be of the same size and construction series, different housings may have to be provided if the basic tool is to have different operating controls. An additional problem arose in that internal connections were necessary within the tool itself to interconnect circuit components and networks if more than two machine functions were to be controlled from any one point. The additional wiring introduced additional labor costs as well as itself requiring additional space for the connecting leads.

Difficulties have been experienced in standardization of components and elements of hand tools, appliances, and the like, if more than two operating functions were to be provided. Additional difficulties arose with placement and location of the required circuit components.

It is an object of the present invention to provide a standard combined, multiple-function switching unit in which various operating functions can be combined so that a single tool or appliance housing can be used and yet different functions of the operating control can be accomodated.

SUBJECT MATTER OF THE PRESENT INVENTION

Briefly, a switch housing is provided with an ON-OFF switch in the housing, and an operating handle which is manually accessible protruding from the housing. A first operating control circuit and a first control element, likewise manually accessible, is attached to the housing. At least one additional operating control circuit is connected to the housing; the additional operating control circuit may have an additional control element which is externally accessible. The switch housing and the first as well as the additional control elements form a unitary assembly; preferably, the first and the additional control elements are separably and removably attached to the housing to permit interchange of the control function. Yet another operating control circuit may be attached to the switch housing; preferably, the handle of the tool or appliance, or the portion thereof in which the switch unit is to be installed, is designed to provide sufficient space for the switch and three attached, associated operating control circuits or elements.

The multiple-function, hand-actuated switch unit has the advantage that at least three operating functions can be controlled thereby. In the vast majority of cases, therefore, additional switch or control units or elements are not required. Thus, all control functions for the respective appliance or tool can be combined in one unitary assembly, and the manually accessible elements are neatly grouped together. The arrangement, being modular in construction, permits interchange of the operating functions which are to be associated with the switch. Preferably, the various components are made to have similar external dimensions so that tools or appliances of any one manufacturing series can be designed to use the same outer housing or case, independently of the operating controls associated with the particular tool or appliance then being built. This substantially reduces costs in the manufacture since only one type of outer housing for the tool need be made; additionally, storage of replacement parts and at after-service locations is reduced since the specific units or elements to be associated with a type of switch can be associated together from modular components.

DRAWINGS, ILLUSTRATING AN EXAMPLE

Figure 1:
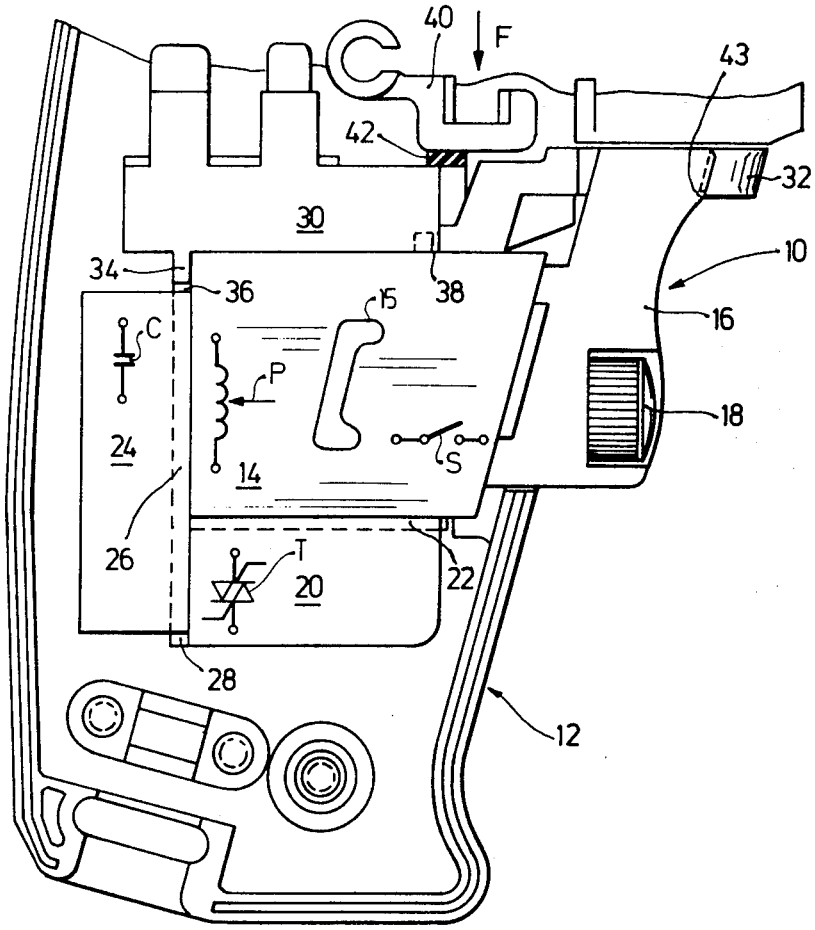
FIG. 1 is a schematic plan view of a portion of the handle of an electric drill, with the top cover removed, and illustrating the switch unit assembled to the handle of the drill, in which the functions are schematically indicated.

An electric drill (not further shown) has a handle 12 which may consist of two halves suitably secured together, for example by screws. The construction of the handle itself is well known and is shown only schematically. A switch unit 10 is located in the handle and placed for connection to a connecting cord, or plug unit (not shown) which can be pinched in a locating groove seen at the bottom part of the handle 12.

The switch unit 10 has a switch housing 14 and an operating trigger handle 16. The switch function is ON-OFF, as schematically shown by the electrical symbol S. It is located within the handle 12, for example by interengaging projection-and-recess means formed, respectively, on the switch housing 14 and on the handle. For example, the switch housing may have a slightly channel-shaped depression 15, matched by a similar projection formed on the half of the handle which is removed from the representation of FIG. 1, and engaging the depression 15. A similar matching arrangement is preferably provided on the side of the switch which is hidden by the switch unit 14 itself. A turn button 18 is located on the switch unit to limit the depression of the handle or trigger 16. The turn button 18 is provided if, in addition to the ON-OFF function of the switch unit 18, the switch 18 is further to be used as a speed control. The speed control circuit itself is located in unit or element 20 which includes the electronics, typically a triac T. Speed control is effected by selective depression of the trigger 16 — as limited by knob 18 — and consequent shifting of the position of a slider of a potentiometer P. The speed control circuit, itself, is well known. The knob 18, as such, is used as a set knob to limit the extent of depression of trigger 16 and thus limit the maximum speed which the drill can obtain.

The housing 14 of the switch and the housing of the element 20 are formed with matching interengaging tongue-and-groove connections 22, preferably in form of a dovetail connection. Thus, unit 20 is releasably, removably connected to the bottom of the switch housing 14. It can be placed at any suitable position with respect to the switch housing. A radio frequency (RF) suppressor capacitor 24, as schematically shown by the diagram C, is located at the back side of the housing 14. A dovetail, tongue-and-groove connection 26 is provided to connect the capacitor 24 to the housing 14. The tongue-and-groove connection of the capacitor 24 is preferably long enough to overlap and fit into a similar tongue-and-groove connection or a dovetail formed at the rear edge of the element 20.

Figure 2:
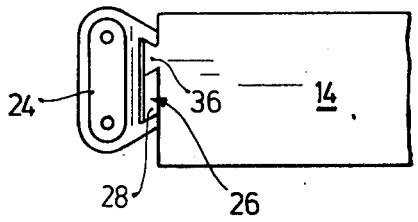
FIG. 2 is a top view of the switch unit and an associated interference suppression capacitor, with one of the switch elements removed.

FIG. 2 clearly shows the connection of the capacitor 24 with the housing 14 of the switch. The housing 14 is preferably formed with a dovetail projection 36. The housing of the capacitor 24 is formed with in-turned edges fitting around the overlapping projection 36. The electronic element 20 is formed with a dovetail projection similar to projection 36. Upon insertion of a connecting element which, in cross section, has essentially parallelogram shape and shown at 28 (FIGS. 1, 2), unit 20 as well as capacitor 24 are securely attached together and to the housing 14. Two additional elements are thereby securely connected to the housing 14. The housing 14 may, of course, be formed with a single dovetail projection extending between the in-turned edges of the housing of capacitor 24 and unit 20 with a similar dovetail end. For assembly, unit 20 is assembled with its dovetail connection 22 on the housing 14, and capacitor 24 is then slid over the aligned combination of the housing 14 and the element 20.

Figure 3:
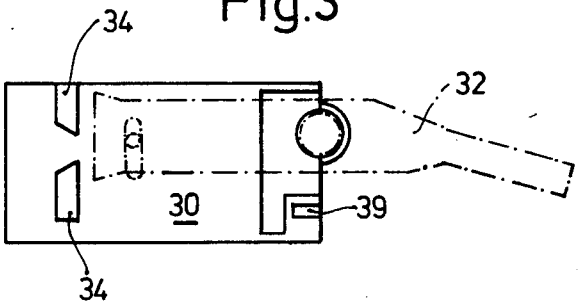
FIG. 3 is a bottom view of a switch element having an overload-reset function and showing associated interengaging means to locate the switch element on the switch unit.

A fourth functional element can readily be associated with the combination of switch 14, element 20 and capacitor 24. The fourth functional unit 30 may, for example, be a speed reversing switch, or a resettable overload protection circuit or cut-out 30 with a manual control lever 32. As seen in FIG. 3, which is a bottom view of element 30, the element 30 is formed with downwardly extending projections 34 which, together, define a dovetail. This dovetail, together with the wedge element 28 (FIGS. 1, 2) or with a similar dovetail on the capacitor 24, forms a connection between the element 30 and the housing 14 of the ON-OFF switch S. The element 30 is additionally located on the housing 14 by a projection-and-recess connection formed by a pin 38 projecting from housing 14 and engaging in a matching recess 39 of element 30. The housing 30 is located within the handle 12 of the tool by a holder 40 which, for example, is spring-loaded as schematically shown by spring force arrow F. A resilient cushion 42 presses housing 30 downwardly so that it will be resiliently and securely held in position, with the dovetail connection at the end portion, that is, at the left in FIG. 1, and with the pin-and-recess connection 38, 39 towards the right side thereof.

The switch trigger 16 is preferably so arranged that the portion at the upper right side thereof — as seen in FIG. 1 — is formed with a forward wall extending approximately at right angles to the plane of the figure, and which has a break-away panel therein of such size that it permits introduction of the switch lever 32 if the panel is broken out. To permit ready break-away, break lines forming weakened portions are placed at the forward wall. These break lines are shown as dashed line 43 in FIG. 1. If it is desired to use an element 30 which has a manual switch-over or reset lever 32 (FIG. 3), then the break-away panel at the forward part of the trigger 16 is broken off along lines 43 to provide an opening for the lever 32. If unit 30 is not to be used, or an element is used therein which need not be manually accessible, then the break-away panel at the front side of the trigger 16 of switch 14 is left intact. Thus, an identical switch 14, with identical trigger 16 may be used with tools which require a cut-out overload, or which are to be used with a rotation-reversing switch, or which are to be provided with a speed range switch, for example two ranges, rather than the continuously variable arrangement using a potentiometer and a triac control 20. Thus, the same basic construction of the trigger 16 and switch 14 can be used with, or without a change-over or resetting switch control 32; for example, unit 30 may be a totally enclosed bi-metal overload cut-out which provides a bi-metal cut-out acting directly on the switch S and controlled by trigger 16, without a manual recess.

The interconnection of the various elements 20, 24, 30 with the switch 5 in housing 14 is preferably done by means of severable plugs, clamping connections, or the like, to associate the elements with the switch to have at least three functions. The use of separable components which can readily be severed by disengaging electrical plug-and-socket connections is not a necessary feature of the present invention, however. For example, the ON-OFF switch S and an overload protective switch in unit 30 can be associated together as a single unit; or, for example, the ON-OFF switch S and an electronic speed control element 20 can be combined directly as one unit. Additional functions can then be associated with the respective units, for example by then attaching an RF suppression capacitor, an overload switch, or a rotation reversal switch, as desired, to provide yet another control function for the respective tool or appliance. If the tool or appliance is to be made in very large quantities with the same operating functions for all units to be manufactured, then the switch unit can be constructed already when originally made with severable plug-and-socket connections or the like. It is desirable, however, to provide a severable connection for an RF suppression capacitor, if used, since this is an element which may fail and which may require replacement even though the remaining elements of the respective tool or appliance are functioning perfectly.

The chamber of the respective tool or appliance, typically a drill handle (as shown) in which the space for the unit is supplied should be of sufficient size to accomodate the switch unit and to position the switch unit housing 14, and at least two additional units therein, preferably in the position of the capacitor 24 and either one of the elements 20 or 30 although, in a preferred form, sufficient space should be provided for three additional functions besides the main ON-OFF switch S.

Various changes and modifications may be made within the scope of the inventive concept.

I claim:

1. Selectively multiple-function, hand-actuating switch unit structure system, particularly for electrical hand tools, appliances or the like, to provide the function (a) ON-OFF and, selectively, at least two of the functions of (b) speed control; (c) overload protection; (d) forward-reverse rotation; (e) radio frequency (RF) interference suppression;

said switch unit system comprising a plurality of functional circuit structure units, each located in a separate respective enclosure, and providing at least two of said functions (b) to (e), and each formed with at least one attachment surface;

a switch housing (14) forming a switch enclosure and having a plurality of attachment surfaces for selective attachment thereto of selected ones of said circuit structure units;

an ON-OFF switch (S) in said switch housing (14) and a switch operating handle (16) therefor, which is manually accessible, protruding from the housing;

a first one of said circuit structure units forming an operating control circuit (20) electrically connectable to said switch unit, and a first control element (18) therefor, which is manually accessible, protruding from the switch housing (14), an additional (30) of said circuit structure units forming an additional operating control circuit, electrically connectable to said switch unit (14), said additional operating control circuit including a further manually accessible control element (32);

and mutually interengaging separable projection-and-recess means formed on said attachment surfaces of said switch enclosure and on the enclosures of said first and second functional circuit structure units to removably and selectively attach together the switch housing forming the switch enclosure and, selectively, said two selected ones of said operating control circuits (20, 30) in their respectively separate enclosures.

2. Unit according to claim 1, wherein said projection and recess means comprise dovetail joints.

3. Unit according to claim 1, wherein said first operating control circuit comprises a speed control and said additional operating control circuit comprises an overload protection switch.

4. Unit according to claim 1, wherein said first operating control circuit (20) comprises a speed control and said additional operating control circuit (30) comprises a transfer switch.

5. Unit according to claim 1, further including a third functional circuit structure unit assembled to an attachment surface of said switch housing (14), said third unit comprising an RF interference suppression capacitor.

6. Unit according to claim 5, wherein the attachment surfaces of the housing are located at three sides defining planes intersecting at right angles;

and said projection and recess means comprises matching dovetail connections formed on three adjacent surfaces of the housing, the enclosures of said first control circuit (20) and one of said additional second or third control circuits (24, 30) extending from one side of the switch housing (14) in overlapping relation to the other of said circuits the overlapping surface being formed with similar dovetail connections to provide an interengaging fit to securely assembly the enclosures of the circuits and of the switch housing together.

7. For combination with the switch unit of claim 1, an electric drill handle construction comprising a hollow handle (12), a chamber formed in said handle, said chamber being of sufficient size to accomodate said switch unit and to position said switch housing (14), said first control circuit unit (20), said second control circuit unit (30) and an additional third control circuit unit (24) therein.

8. Unit according to claim 1, wherein the housing — in plan view — is essentially rectangular;

the attachment surfaces of the housing are formed on three circumferentially adjacent sides, whereby said attachment surfaces will be located at two parallel sides and at one side connecting said parallel sides;

said projection and recess means comprise matching dovetail connections;

the enclosure of said first control circuit unit (20) and said second control circuit (30) being located at opposite, parallel sides and extending up to the third connecting side, at least one of said circuit structure units being formed with an additional attachment surface thereon matching the dovetail connection on said third connecting side;

and a third circuit structure unit (24) having its enclosure formed with a matching dovetail connection assembled to said third, connecting side and to the additional attachment surface of said at least one first, or second circuit structure unit.

* * * * *